US007632793B2

(12) United States Patent
Lang

(10) Patent No.: US 7,632,793 B2
(45) Date of Patent: Dec. 15, 2009

(54) WASHING AND CLEANING AGENTS CONTAINING ACETALS AS ORGANIC SOLVENTS

(75) Inventor: Frank-Peter Lang, Hattersheim (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 0 days.

(21) Appl. No.: 11/886,497

(22) PCT Filed: Mar. 6, 2006

(86) PCT No.: PCT/EP2006/002015

§ 371 (c)(1),
(2), (4) Date: Sep. 14, 2007

(87) PCT Pub. No.: WO2006/097214

PCT Pub. Date: Sep. 21, 2006

(65) Prior Publication Data

US 2008/0194453 A1 Aug. 14, 2008

(30) Foreign Application Priority Data

Mar. 15, 2005 (DE) ..... 10 2005 011 719

(51) Int. Cl.
*C11D 3/20* (2006.01)

(52) U.S. Cl. ..... 510/109; 510/101; 510/417; 510/421; 510/405; 510/176; 510/506; 209/166

(58) Field of Classification Search ..... 510/101, 510/417, 421, 405, 176, 506, 109
See application file for complete search history.

(56) References Cited

U.S. PATENT DOCUMENTS

| | | | | |
|---|---|---|---|---|
| 2,194,405 | A | 3/1940 | Purves | |
| 2,321,094 | A | 6/1943 | Macdowell | |
| 2,591,289 | A * | 4/1952 | Powell et al. | 209/166 |
| 2,657,800 | A * | 11/1953 | Hall | 209/166 |
| 2,785,947 | A | 3/1957 | Kress | |
| 3,382,176 | A * | 5/1968 | Gotte et al. | 510/514 |
| 4,216,105 | A * | 8/1980 | Davidson et al. | 510/394 |
| 4,541,835 | A | 9/1985 | Norton | |
| 4,541,837 | A | 9/1985 | Norton | |
| 4,619,668 | A | 10/1986 | Frick | |
| 5,191,127 | A | 3/1993 | Babler | |
| 5,766,758 | A | 6/1998 | Hirakawa | |
| 6,013,842 | A | 1/2000 | Groening | |
| 6,177,070 | B1 | 1/2001 | Lynch | |
| 6,281,184 | B1 * | 8/2001 | Michaud et al. | 510/410 |
| 7,008,458 | B2 | 3/2006 | Hayday | |
| 2002/0061827 | A1 * | 5/2002 | Miller et al. | 510/417 |
| 2004/0186304 | A1 | 9/2004 | Ruwwe | |
| 2004/0226105 | A1 | 11/2004 | Hayday | |
| 2007/0073088 | A1 | 3/2007 | Simon | |
| 2008/0096785 | A1 * | 4/2008 | Egbe et al. | 510/176 |
| 2008/0166315 | A1 * | 7/2008 | DuBois | 424/75 |
| 2008/0312118 | A1 * | 12/2008 | Futterer et al. | 510/180 |
| 2009/0011969 | A1 * | 1/2009 | Lang | 510/258 |
| 2009/0029895 | A1 * | 1/2009 | Scialla et al. | 510/180 |
| 2009/0030241 | A1 | 1/2009 | Lang | |
| 2009/0031504 | A1 * | 2/2009 | Lang | 8/142 |

FOREIGN PATENT DOCUMENTS

| | | |
|---|---|---|
| DE | 2132898 | 1/1973 |
| DE | 10042514 | 3/2002 |
| EP | 0030429 | 6/1981 |
| EP | 0679179 | 11/1995 |
| EP | 0801157 | 10/1997 |
| EP | 0847976 | 6/1998 |
| EP | 0890670 | 1/1999 |
| EP | 1184448 | 3/2002 |
| EP | 1460052 | 9/2004 |
| GB | 559362 | 2/1944 |
| JP | 11043818 | 2/1999 |
| WO | 2004106274 | 12/2004 |

OTHER PUBLICATIONS

Int'l Search Report for PCT/EP2006/PCT/EP2006/002015, mailed Jun. 15, 2006.
German Office Action for corresponding Application No. DE102005011719.8, mailed Feb. 3, 2006.
English Lang. translation of International Preliminary Examination Report for PCT/2006/00214, Oct. 3, 2007.
English language machine translation of DE2132898 (Jan. 18, 1973).
English language machine translation of JP043818 (Feb. 2, 2006).
Kliegman, J. et al., "Glyoxyl Derivatives the Formation of Glycolates . . .", J. Organic Chem, vol. 39, No. 12,1974, pp. 1777-1776.

* cited by examiner

*Primary Examiner*—Mark Eashoo
*Assistant Examiner*—Jane L Stanley
(74) *Attorney, Agent, or Firm*—Tod A. Waldrop

(57) ABSTRACT

The invention relates to washing and cleaning agents containing, as solvents a compound of formula (1),

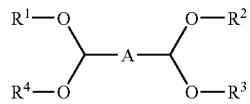

(1)

wherein A is $(CH_2)_a$ or phenylene, $R^1$, $R^2$, $R^3$, and $R^4$ identically or independently denote $C_1$ to $C_{22}$-n- and/or iso-alkyl, $C_5$- or $C_6$-cycloalkyl, phenyl-$C_1$-$C_4$-alkyl, $C_1$-$C_9$-alkylphenyl or phenyl, A is $(CH_2)_a$, and a is an integer from 0 to 6.

5 Claims, No Drawings

WASHING AND CLEANING AGENTS CONTAINING ACETALS AS ORGANIC SOLVENTS

Organic solvents which are completely soluble, partially soluble or insoluble in water are used in a multiplicity of washing and cleaning compositions. These comprise not only products for use in the home but also products for industrial and institutional use.

Solvent-containing washing and cleaning compositions used in the home or in industry are in particular those which are present in liquid form, in gel form or in paste form. They include in particular liquid laundry detergents, washing pastes, washing gels, prewash sprays, stain sprays, detergent boosters, spot dissolvers, fabric conditioners, all-purpose cleaners, washing up liquids, liquid dishwasher detergents, dishwasher rinse aids, oven cleaners, grill cleaners, glass cleaners, stainless steel cleaners, bathroom cleaners, kitchen cleaners, engine cleaners, tar removers, insect removers, car-drying agents for car washes, windshield cleaners, wax film removers, rim cleaners, spray extraction cleaners, brush cleaners, polishing pastes and plastic cleaners.

Depending on the volatility of the organic solvents, however, they can also be used in pulverulent washing and cleaning compositions. Incorporation into a waxy matrix is likewise possible.

Examples of the use of organic solvents in pulverulent or tableted cleaners are for example those which are used as dishwasher detergents. Examples of organic solvents which are completely soluble, partially soluble or else insoluble in water and which can be used in washing and cleaning compositions are:

monohydric alcohols, such as ethanol, n-propanol, isopropanol, n-butanol, isobutanol and tertiary butanol.

Di- or more highly hydric alcohols such as ethylene glycol, 1,2-propylene glycol, 1,3-propylene glycol, butylene glycol or glycerol.

Ethers, in particular glycol ethers obtained by reaction of $C_1$-$C_6$-alcohols or of phenol with one or more moles of an alkylene oxide, in particular with ethylene oxide or propylene oxide. Examples of glycol ethers are mono-, di- and tripropylene glycol monomethyl ethers, propylene glycol phenyl ether, mono- and diethylene glycol n-butyl ethers, ethylene glycol phenyl ether.

Ketones such as for example methyl isopropyl ketone and 2-butanone.

Esters, for example propyl acetate.

Oligo- and polyalkylene glycols such as for example diethylene glycol, dibutylene glycol or low molecular weight polyethylene glycol, for example having the molar masses 300 and 400 (PEG 300 and PEG 400).

Terpenes, for example orange terpene.

n-Alkanes and isoalkanes of various chain lengths and having different degrees of branching or having specific boiling ranges, paraffin oil, petroleum, white spirit. Nitrogenous solvents such as N-methylpyrrolidone for example.

The solvents may perform completely different functions in the formulations. They include for example boosting the cleaning performance especially with regard to greasy and oily stains due to, for example, foods, (machine) oil, shoe polish, salves, petroleum jelly and cosmetics. Specific stain removers are intended to detach very specific stains due to, for example, adhesives, chewing gum, nail varnish, floor polish, resins, waxes and tar. Also to be mentioned are the stabilization of formulations, an effect as solubilizers including in particular for highly concentrated or polymer-containing formulations, improving the low temperature stability and the "clarification" of opaque and somewhat cloudy formulations.

Examples of solvent-containing washing, cleaning and care compositions are:

Liquid Laundry Detergents

Liquid laundry detergents may contain, for example, ethanol or 1,2-propanediol as a solubilizer.

TABLE 1

Solvent-containing liquid laundry detergent

| Composition | (%) |
|---|---|
| Secondary alkane sulfonate, 60% | 13.0 |
| Soap | 10.0 |
| $C_{12/14}$ Fatty alcohol 7EO polyglycol ether | 23.0 |
| 1,2-Propanediol | 5.0 |
| Water | ad 100 |

Prewash Sprays, Stain Sprays or Wash Enhancers for Textiles

TABLE 2

Solvent-containing stain spray A for textiles

| Composition | (%) |
|---|---|
| Isoalkanes | 70 |
| Esters | 3 |
| Ethanol | 6 |
| Nonionic surfactants | 15 |
| Cationic surfactants | 5 |
| Water | 1 |

TABLE 3

Solvent-containing stain spray B for textiles

| Stain spray B for textiles<br>Composition | (%) |
|---|---|
| Dipropylene glycol monomethyl ether | 5 |
| Diethylene glycol monobutyl ether | 10 |
| Isopropanol | 10 |
| N-Methylpyrrolidone | 2 |
| Nonionic surfactants | 3 |
| Anionic surfactants | 1 |
| Soap | 1 |
| Water | ad 100 |

TABLE 4

Solvent-containing stain spray C for textiles

| Composition | (%) |
|---|---|
| Ethanol | 8 |
| Isopropanol | 5 |
| Nonionic surfactants | 13 |
| Anionic surfactants | 1 |
| Water | ad 100 |

Stain Removers

Stain removers may consist, for example, exclusively of aliphatic n- and/or isoalkanes. In that case they are also known as "benzine". But in addition other solvents may be present, such as alcohols.

Fabric Conditioner

TABLE 5

| Solvent-containing fabric conditioner | |
|---|---|
| Composition | (%) |
| Distearyldimethylammonium chloride | 17.2 |
| Polyethylene glycol 400 | 6.1 |
| Stearylamine ethoxylate with 25EO | 1.7 |
| 1,2-Propanediol | 7.5 |
| $MgCl_2$, 10% | 1.5 |
| HCl, 5 N | 0.25 |
| Perfume | 1.0 |
| Colorant | q.s. |
| Water | ad 100 |

All-Purpose Cleaner

The following all-purpose cleaners can be used in the home to clean various surfaces composed of plastics material, linoleum, ceramics, brick, enamel, stainless steel, glass and other hard surfaces:

TABLE 6

| Solvent-containing all-purpose cleaner A for hard surfaces | |
|---|---|
| Composition | (%) |
| $C_{12/14}$ Alkyl 5EO ether Na carboxylate, 90% | 2.3 |
| $C_{11}$ Oxo alcohol 8EO polyglycol ether | 2.5 |
| Propylene glycol n-butyl ether | 2.0 |
| Water | ad 100 |

TABLE 7

| Solvent-containing all-purpose cleaner B for hard surfaces | |
|---|---|
| Composition | (%) |
| Secondary alkanesulfonate, 60% | 1.7 |
| $C_{11}$ Oxo alcohol 8EO polyglycol ether | 4.0 |
| Polycarboxylate | 2.0 |
| Propylene glycol n-butyl ether | 0.5 |
| Water | ad 100 |

TABLE 8

| Solvent-containing all-purpose cleaner C for hard surfaces | |
|---|---|
| Composition | (%) |
| Secondary alkanesulfonate, 30% | 11.7 |
| $C_{12/15}$ Oxo alcohol EO/PO adduct | 1.5 |
| Ethanol | 2.5 |
| Hydrogen peroxide, 35%, stabilized | 2.0 |
| Sodium hydroxide solution | q.s. |
| Water | ad 100 |

Washing Up Liquids

TABLE 9

| Solvent-containing washing up liquid | |
|---|---|
| Composition | (%) |
| Secondary alkanesulfonate, 60% | 43.8% |
| $C_{12/14}$ Alkyl 2EO ether sulfate, Na salt, 27% | 32.4% |
| $C_{11}$ Oxo alcohol 8EO polyglycol ether | 1.0% |
| Terpenes | 4.0% |

TABLE 9-continued

| Solvent-containing washing up liquid | |
|---|---|
| Composition | (%) |
| Polyglycol 400 | 4.0% |
| Perfume, colorant, preservative | q.s. |
| Water | ad 100 |

Detergent Tablets for Dishwasher

TABLE 10

| Solvent-containing dishwasher tablets | |
|---|---|
| Composition | (%) |
| $C_{8/10}$ Alcohol alkoxylate with 6 ethylene oxide and 2 propylene oxide | 7.0 |
| Hydrocarbons | 4.0 |
| $Na_5P_3O_{10}$ | 55.0 |
| Sodium carbonate | 19.0 |
| $Na_2O_2SiO_2$ | 3.5 |
| Zeolite A | 0.4 |
| Borax | 0.6 |
| Hydroxyethanediphosphonic acid | 0.2 |
| Protease | 0.1 |
| Amylase | 0.2 |
| Water | 10.0 |

Dishwasher Rinse Aid

TABLE 11

| Solvent-containing dishwasher rinse aid | |
|---|---|
| Composition | (%) |
| End group capped fatty alcohol ethoxylate | 30.0 |
| 1,2-Propylene glycol | 5.0 |
| Water | ad 100 |

Glass Cleaners

Glass cleaners are used for cleaning large areas of glass. Examples are windows, mirrors and glass tables. The cleaner must not leave any residues, for example in the form of stripes, behind.

TABLE 12

| Solvent-containing glass cleaner A | |
|---|---|
| Composition | (%) |
| $C_{12/14}$ Alkyl 2EO ether sulfate, Na salt, 27% | 0.5 |
| Ammoniacal water, 25% | 0.5 |
| Ethanol | 29.0 |
| Water | ad 100 |

TABLE 13

| Solvent-containing glass cleaner B | |
|---|---|
| Composition | (%) |
| $C_{12/14}$ Alkyl polyglycoside | 0.5 |
| Ammoniacal water, 25% | 0.2 |
| Isopropanol | 5.0 |
| Water | ad 100 |

TABLE 14

| Solvent-containing glass cleaner C | |
|---|---|
| Composition | (%) |
| Monomethyl phosphate | 2.0 |
| Oleyl alcohol 8EO polyglycol ether | 0.3 |
| $C_{12/15}$ Oxo alcohol 8EO polyglycol ether | 0.3 |
| Isopropanol | 10.0 |
| Water | ad 100 |

Stainless Steel Cleaner for the Home (for Kitchen Sinks for Example)

These are used in the home to clean kitchen sinks for example. They contain abrasive materials, for example polishing alumina, to remove stubborn stains.

TABLE 15

| Solvent-containing stainless steel cleaner for the home | |
|---|---|
| Composition | (%) |
| Polydimethylsiloxane | 1.0 |
| Paraffin oil | 3.0 |
| Emulsifier | 4.5 |
| Fatty alcohol polyglycol ether | 1.0 |
| Polishing alumina | 35.0 |
| Ethanol | 4.0 |
| Fatty alcohol polyglycol ether | 1.0 |
| Citric acid | 3.0 |
| Water | ad 100 |

Bathroom Cleaner

Bathroom cleaners are used for example to detach lime or lime soap residues from sanitary objects, tiles and fittings. Organic solvents may be among their ingredients.

TABLE 16

| Solvent-containing bathroom cleaner composition | |
|---|---|
| Composition | (%) |
| Fatty alcohol polyglycoside | 2.0 |
| Octyl alcohol 4EO polyglycol ether | 3.0 |
| Citric acid, 50% | 0.5 |
| Isopropanol | 3.0 |
| Water | ad 100 |

Cleaning and Care Compositions for Motor Vehicles

The following formulations exemplify solvent-containing cleaners for motor vehicles.

TABLE 17

| Engine cleaner | |
|---|---|
| Composition | (%) |
| $C_{16/18}$ Fatty alcohol 5EO polyglycol ether | 5.0 |
| Tallow oil fatty acid diethanolamide | 1.0 |
| Petroleum | ad 100 |

TABLE 18

| Tar remover for autos | |
|---|---|
| Composition | (%) |
| Secondary alkanesulfonate, 60% | 15.0 |
| $C_{11}$ Oxo alcohol 3EO polyglycol ether | 2.0 |
| Oleic acid | 3.0 |
| Butanol | 7.0 |
| White spirit | 60.0 |
| Water | ad 100 |

TABLE 19

| Insect remover | |
|---|---|
| Composition | (%) |
| $C_{12/15}$ Oxo alcohol 8EO polyglycol ether | 3.0 |
| Ethylene glycol | 30.0 |
| Ethanol | 20.0 |
| Ammoniacal water, 25% | 1.0 |
| Water | ad 100 |

TABLE 20

| Car-drying agents for car washes | |
|---|---|
| Composition | (%) |
| Butyldiglycol | 15.0 |
| $C_{16/18}$ Fatty alcohol 5EO polyglycol ether | 2.0 |
| Mineral oil | 2.0 |
| Di-$C_{16/18}$-alkyldimethylammonium chloride | 10.0 |
| Water | ad 100 |

TABLE 21

| Windshield cleaner, winter grade for temperatures down to −60° C. | |
|---|---|
| Composition | (%) |
| Isopropanol | 87.0 |
| 1,2-Propylene glycol | 2.0 |
| $C_{12/14}$ Alkyl 2EO ether sulfate, Na salt, 27% | 1.0 |
| Water | ad 100 |

TABLE 22

| Wax film remover | |
|---|---|
| Composition | (%) |
| $C_{12/14}$ Alkyl 2EO ether sulfate, Na salt | 3.0 |
| Fatty alcohol polyalkylene glycol ether | 2.0 |
| Caustic soda, 45% | 2.0 |
| Butylglycol or butyldiglycol | 5.5 |
| Water | ad 100 |

TABLE 23

| Rim cleaner | |
|---|---|
| Composition | (%) |
| Tetrapotassium pyrophosphate | 3.0 |
| Secondary alkanesulfonate, 60% | 4.0 |
| $C_{11}$ Oxo alcohol 5EO polyglycol ether | 10.0 |

TABLE 23-continued

| Rim cleaner | |
|---|---|
| Composition | (%) |
| Butyl glycol | 5.0 |
| Water | ad 100 |

As well as the classic washing and cleaning compositions for the home and autos there are further solvent-containing cleaners having quite different applications such as, for example:

TABLE 24

| Spray extraction cleaner | |
|---|---|
| Composition | (%) |
| Needle soap | 1.0 |
| Anionic surfactant | 5.0 |
| Fatty alcohol polyalkylene glycol ether | 5.0 |
| Polyacrylate dispersion, 40% | 4.0 |
| Isopropanol | 10.0 |
| Water | ad 100 |

TABLE 25

| Brush cleaner | |
|---|---|
| Composition | (%) |
| Mixture of anionic and nonionic surfactants | 10.0 |
| Fatty alcohol polyalkylene glycol ether | 10.0 |
| Orange terpene | 10.0 |
| Coco fatty acid diethanolamide | 4.0 |
| Dipropylene glycol monomethyl ether | 66.0 |

TABLE 26

| Polishing pastes for chrome surfaces | |
|---|---|
| Composition | (%) |
| Partially saponified montan ester wax | 2.0 |
| Stearic acid | 3.0 |
| Oleic acid | 0.7 |
| Paraffin oil | 4.9 |
| Universal spirits | 36.2 |
| Alumina (particle size as required) | 35.0 |
| Diatomaceous earth (quartz/kaolinite, particle size as required) | 17.0 |
| Finely divided silica | 1.2 |

The recited formulations are only intended to document a use of organic solvents in washing and cleaning compositions. However, they do not constitute recommendations and, if emulated, have to be tested by the user for suitability.

Prior art solvents each have specific disadvantages. For instance, the flashpoint of ethanol or of isopropanol is very low at 12° C., limiting the concentrations in which they are used in washing and cleaning compositions.

In addition, the fat-dissolving power of these alcohols is limited.

Glycol ethers do have a high flashpoint, for example about 80° C. in the case of dipropylene glycol monomethyl ether, but again their dissolving power for fats and oils is limited.

Aliphatic hydrocarbons are lipophilic and so possess good dissolving power for fatty and oily stains, but can be incorporated in aqueous surfactant systems only to a limited extent.

The present invention has for its object to provide organic solvents which possess very good dissolving power for fats and oils coupled with sufficient polarity so that they are easy to incorporate into aqueous preparations over wide concentration ranges.

EP 1 184 448 describes aqueous fluids comprising an acetal and a surfactant. These fluids, unlike the hereinbelow described washing and cleaning compositions of the present invention, exist only in the form of microemulsions or as liquid-crystalline phases. Moreover, the acetals serve only as solubilizers in EP 1 184 448. The actual cleaning performance is provided by conventional surfactants.

It has now been found that, surprisingly, compounds of the formula (1) in themselves possess very good cleaning or dissolving capacity for fatty and oily stains while at the same time being very readily incorporable in aqueous formulations. But at the same time, the compounds of the formula (1) can also be used in waterless formulations as a substitute for aliphatic hydrocarbons for example. In addition, they possess a favorable toxicological and ecological profile.

The present invention accordingly provides washing and cleaning compositions comprising as a solvent a compound of the formula (1)

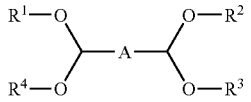

(1)

where

A is $(CH_2)_a$ or phenylene, $R^1$, $R^2$, $R^3$ and $R^4$ may, identically or independently, be $C_1$ to $C_{22}$-n- and/or isoalkyl, $C_5$- or $C_6$-cycloalkyl, phenyl-$C_1$-$C_4$-alkyl, $C_1$-$C_{13}$-alkylphenyl or phenyl and a is an integer from 0 to 6.

Preferably, $R^1$, $R^2$, $R^3$ and $R^4$ identically or independently denote $C_1$ to $C_{13}$-n- and/or isoalkyl, $C_5$- or $C_6$-cycloalkyl, phenyl-$C_1$-$C_2$-alkyl, $C_1$-$C_9$-alkylphenyl or phenyl and a is preferably 0 to 2.

More preferably, $R^1$, $R^2$, $R^3$ and $R^4$ identically or independently denote $C_1$ to $C_8$-n and/or isoalkyl, cyclohexyl, benzyl or phenyl and a is preferably 0 or 1.

Most preferably, $R^1$, $R^2$, $R^3$ and $R^4$ identically or independently denote $C_1$ to $C_6$-n- and/or isoalkyl and a is 0.

Examples of the R1 to R4 radicals are for example: methyl, ethyl, n-propyl, isopropyl, n-butyl, iso-butyl, sec-butyl, tert-butyl, n-amyl, iso-amyl, tert-amyl, neopentyl, cyclopentyl, n-hexyl, isohexyl, cyclohexyl, octyl, decyl, isotridecyl, phenyl, benzyl, phenylethyl, nonylphenyl.

The compounds of the general formula (1) are acetals. Acetals are generally obtained by reaction of aldehydes with 2 mol of an alcohol per carbonyl group in the presence of catalysts, such as dry hydrogen chloride for example.

Dialdehydes have to be used to synthesize compounds of the formula (1). Preferred dialdehydes for synthesizing compounds of the formula (1) are glyoxal, malonaldehyde (1,3-propanedial, 1,3-propanedialdehyde), 1,4-butanedial and terephthalaldehyde. Glyoxal is a very preferred dialdehyde.

A particularly preferred compound for the purpose described is tetramethoxyethane (2).

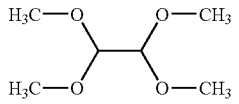

(2)

The invention also provides for the use of compounds of the formula (1) or (2) for cleaning and dissolving stains on solid surfaces. The invention also accordingly provides a method of cleaning solid surfaces wherein the solid surfaces are treated with a composition comprising a compound of the formula (1). Solid surfaces which can be cleaned using the acetals of the formula (1) or (2) are in particular textile fibers or else metallic or ceramic surfaces, glass, porcelain or plastics.

The solvents of the formula (1) and particularly tetramethoxyethane (2) can be used in liquid laundry detergents, washing pastes, washing gels, prewash sprays, detergent boosters, stain sprays, stain removers, fabric conditioners, all-purpose cleaners, washing up liquids, dishwasher detergents, dishwasher rinse aids, oven cleaners, grill cleaners, glass cleaners, stainless steel cleaners, bathroom cleaners, kitchen cleaners, carpet cleaners, engine cleaners, tar removers, insect removers, car-drying agents for car washes, windshield cleaners, car shampoos, wax film removers, rim cleaners, spray extraction cleaners, brush cleaners, polishing pastes and plastic cleaners.

Of particular preference here is the use in prewash sprays, wash boosters, stain sprays and stain removers for textiles, liquid laundry detergents, also in all-purpose cleaners, dishwasher detergents, dishwasher rinse aids, kitchen cleaners, glass cleaners, engine cleaners, car-drying agents for car washes, windshield cleaners, car shampoos and in plastic cleaners.

When the volatility of the acetals of the formula (1) is low, which may be achieved through the choice of the R1 to R4 radicals, for example through the choice of long alkyl radicals, they can also be used in solid washing and cleaning compositions which can be present for example as a powder, granule, pellet, wax, as a washing bar or in the form of tablets.

More particularly, the acetals of the formula (1) can be used with success in washing, cleaning and care compositions described at the beginning in tables 1 to 26, each of which is hereby explicitly incorporated herein by reference. All or some of the organic solvents indicated there can be replaced in these compositions by the acetals of the formula (1).

The amount of acetal of the formula (1) in the washing and cleaning compositions of the present invention can vary within wide limits and depends in each specific case on the specific composition of such washing and cleaning compositions.

General information on the composition will now be provided for the most important washing and cleaning compositions.

Prewash sprays, wash boosters and stain sprays may comprise alcohols such as for example ethanol and isopropanol, glycol ethers such as for example dipropylene glycol monomethyl ether, diethylene glycol monobutyl ether, isoalkanes, N-methylpyrrolidone, anionic surfactants, nonionic surfactants, cationic surfactants, amphoteric surfactants, soap, water and 1% to 90%, preferably 5% to 80%, more preferably 10% to 60% and most preferably 11% to 40% of solvent of formula (1), especially tetramethoxyethane (2).

If the stain sprays are also intended to support the removal of bleachable stains such as red wine stains, fruit juice stains, etc., they may further comprise hydrogen peroxide or other bleaching agents.

In one particular embodiment, the solvents of the formula (1) and the bleaching agent, for example hydrogen peroxide, can be applied from two separate chambers, in which case it is only in the course of being applied that the solvent of the formula (1) and the bleaching agent come into contact with each other and with the surface to be cleaned, the surface of a textile for example.

Stain removers may comprise 1% to 100%, preferably 1% to 80%, more preferably 1% to 60% and more preferably 1% to 40% of solvent of the formula (1), especially tetramethoxyethane (2). They may further comprise other volatile organic solvents, examples being alcohols and hydrocarbons.

Liquid laundry detergents may comprise: anionic surfactants, nonionic surfactants, cationic surfactants (for example in the case of detergents for wool) and amphoteric surfactants, soap, builders, enzymes, optical brighteners, polymers such as soil release polymers (in particular those obtained by reaction of dicarboxylic acids such as terephthalic acid and diols), dye transfer inhibitors (for example polyvinylpyrrolidone) and polycarboxylates, complexing agents, water, colorants, perfume, and also 0.5% to 20%, preferably 1% to 10% and more preferably 2% to 5% of solvent of the formula (1), especially tetramethoxyethane (2).

All-purpose cleaners may comprise: anionic surfactants, nonionic surfactants, amphoteric surfactants, soap, phosphates, phosphonic acids and/or citric acid in free form or as a salt, urea, hydrotropes (cumenesulfonate), polymers such as for example polycarboxylates, colorants, perfume, water and 0.1% to 20%, preferably 0.2% to 15%, more preferably 0.5% to 10% and most preferably 1% to 5% of solvent of the formula (1), especially tetramethoxyethane (2).

Glass cleaners may comprise: anionic surfactants, nonionic surfactants, amphoteric surfactants, ammoniacal water, phosphoric esters, water and 1% to 99%, preferably 2% to 50%, more preferably 3% to 40% and most preferably 5% to 30% of solvent of the formula (1), especially tetramethoxyethane (2).

Engine cleaners may comprise: hydrocarbons, anionic surfactants, nonionic surfactants, amphoteric surfactants, water in very small amounts and 1% to 99%, preferably 2% to 50%, more preferably 3% to 40% and more preferably 5% to 30% of solvent of the formula (1), especially tetramethoxyethane (2).

Car-drying agents for car washes may comprise: cationic surfactants, amphoteric surfactants, nonionic surfactants, siloxanes, hydrocarbons, water, and also 0.5% to 20%, preferably 1% to 15%, more preferably 2% to 10% and most preferably 3% to 6% of solvent of the formula (1), especially tetramethoxyethane (2).

Windshield cleaners may comprise: anionic surfactants, amphoteric surfactants, nonionic surfactants, water and 1% to 99%, preferably 2% to 50%, more preferably 3% to 40% and more preferably 5% to 30% of solvent of the formula (1), especially tetramethoxyethane (2).

Washing up liquids may comprise: anionic surfactants, nonionic surfactants, betaines, amine oxides, pearl luster agents, pH regulators such as citric acid, colorants, scents, water and 0.1% to 10%, preferably 0.5% to 7% and more preferably 1% to 5% of solvent of the formula (1).

Dishwasher rinse aids may comprise: low-sudsing nonionic surfactants, solubilizers/hydrotropes such as cumenesulfonate, citric acid and 0.5% to 10% and preferably 0.5% to 5% of solvent of the formula (1).

Washing and cleaning compositions which, in accordance with the present invention, comprise compounds of the formula (1) may further comprise further constituents. These are described in what follows.

Anionic Surfactants

Useful anionic surfactants include sulfates, sulfonates, carboxylates, phosphates and mixtures thereof. Suitable cations are alkali metals, for example sodium or potassium, or alkaline earth metals, for example calcium or magnesium, and also ammonium, substituted ammonium compounds, including mono-, di- or triethanolammonium cations, and mixtures thereof.

The following types of anionic surfactants are particularly preferred: alkanesulfonates, alkyl sulfates, alkyl ether sulfates, alkylbenzenesulfonates, alkyl ester sulfonates and soaps as described in what follows.

Preferred alkyl ester sulfonates, specifically for laundry detergent applications, are compounds of the formula

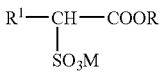

where $R^1$ is a $C_8$-$C_{20}$-hydrocarbyl radical, preferably alkyl, and R is a $C_1$-$C_6$-hydrocarbyl radical, preferably alkyl. M represents a cation which forms a water-soluble salt with the alkyl ester sulfonate, for example sodium, potassium, lithium or ammonium cations, such as monoethanolamine, diethanolamine and triethanolamine.

Alkyl sulfates have the formula $ROSO_3M$, where R is a $C_{10}$-$C_{24}$-hydrocarbyl radical, more preferably a $C_{12}$-$C_{18}$-alkyl radical. M is hydrogen or a cation, for example an alkali metal cation or ammonium or substituted ammonium.

Alkyl ether sulfates have the formula $RO(A)_mSO_3M$, where R is an unsubstituted $C_{10}$-$C_{24}$-alkyl or -hydroxyalkyl radical, more preferably $C_{12}$-$C_{18}$-alkyl radical. A is an ethoxy or propoxy unit, m is a number preferably between about 0.5 and about 3 and M is a hydrogen atom or a cation.

The preferred secondary alkanesulfonates comprise linear alkyl chains having about 9 to 25 carbon atoms, preferably about 10 to about 20 carbon atoms and more preferably about 13 to 17 carbon atoms. The sulfur group may be attached to any desired secondary carbon atom. The cation is preferably sodium.

The preferred alkylbenzenesulfonates comprise linear alkyl chains having preferably about 10 to about 13 carbon atoms, the cation is preferably sodium.

Olefin sulfonates are obtained by sulfonation of $C_8$-$C_{24}$-olefins and preferably $C_{14}$-$C_{16}\alpha$-olefins with sulfur trioxide and subsequent neutralization.

Further anionic surfactants are salts of acylamino carboxylic acids, acylsarcosinates, fatty acid-protein condensation products, salts of alkylsulfamido carboxylic acids, salts of alkyl and alkylaryl ether carboxylic acids, alkyl and alkenyl glycerol sulfates, alkylphenol ether sulfates, alkyl phosphates, alkyl ether phosphates, isethionates, N-acyltaurides, alkyl succinates, sulfosuccinates, monoesters of sulfosuccinates (particularly saturated and unsaturated $C_{12}$-$C_{18}$ monoesters) and diesters of sulfosuccinates (particularly saturated or unsaturated $C_{12}$-$C_{18}$ diesters), acylsarcosinates, sulfates of alkylpolysaccharides such as sulfates of alkylpolyglycosides.

Nonionic surfactants are condensation products of natural or synthetic, straight-chain or branched alcohols with about 1 to about 25 mol of ethylene oxide, mixed alkoxylates of these alcohols with ethylene oxide and propylene oxide or else alcohol ethoxylates which are end group capped with an alkyl group such as butyl; condensation products of ethylene oxide with a hydrophobic base formed by condensation of propylene oxide with propylene glycol; condensation products of ethylene oxide with a reaction product of propylene oxide and ethylenediamine; polyethylene, polypropylene and polybutylene oxide condensates of alkylphenols.

Further surfactants are amine oxides, fatty acid amides such as coco fatty acid diethanolamide, alkyl and alkenyl oligoglycosides, fatty acid polyglycol esters, fatty amine polyglycol esters, alkyl oligoglycosides, alkenyl oligoglycosides, fatty acid N-alkyl glucamides, betaines, for example alkyldimethylammonium betaines, alkylamide betaines such as for example cocoamidopropylbetaine, aminopropionates, aminoglycinates, or amphoteric imidazolinium compounds, aminopropionates, aminoglycinates or amphoteric imidazolinium compounds.

Suitable cationic surfactants are substituted or unsubstituted straight-chain or branched quaternary ammonium salts of the type $R^1N(CH_3)_3{}^{\rho}X^{\sigma}$, $R^1R^2N(CH_3)_2{}^{\rho}X^{\sigma}$, $R^1R^2R^3N(CH_3)^{\rho}X^{\sigma}$ or $R^1R^2R^3R^4N^{\rho}X^{\sigma}$. The $R^1$, $R^2$, $R^3$ and $R^4$ radicals may preferably be independently unsubstituted alkyl having a chain length of between 8 and 24 carbon atoms, especially between 10 and 18 carbon atoms, hydroxyalkyl having about 1 to about 4 carbon atoms, phenyl, $C_2$- to $C_{18}$-alkenyl, $C_7$- to $C_{24}$-aralkyl, $(C_2H_4O)_xH$, where x is from about 1 to about 3, alkyl radicals comprising one or more ester groups, or cyclic quaternary ammonium salts. X is a suitable anion.

Laundry detergent ingredients which may be included in the washing and cleaning compositions of the present invention are alkali metal, ammonium and alkanolammonium salts of polyphosphates such as for example sodium tripolyphosphate; phosphonates such as 1-hydroxyethane-1,1-diphosphonate; citric acid and its soluble salts; carbonates (sodium carbonate); salts of polyacetic acids such as for example ethylenediaminetetraacetic acid and nitrilotriacetic acid; polycarboxylates based on acrylic acid and maleic acid; copolymers of maleic anhydride with ethylene or vinyl methyl ether; soil release polymers, especially soil release polyesters based on dicarboxylic acids and diols; cellulose ethers such as for example methylhydroxyethyl- and methylhydroxypropyl-celluloses; enzymes, especially proteases, lipases, cellulases and amylases, mannanases; gall soap; enzyme stabilizers, foam boosters, foam inhibitors, staining and/or corrosion control agents, emulsifiers (for example sorbitan monooleate), colorants, dye transfer inhibitors, fillers, optical brighteners, disinfectants, alkalis, hydrotropic compounds, antioxidants, perfumes, other solvents such as for example alcohols, glycols, glycerol, ethers, glycol ethers, ketones, esters, oligo- and polyalkylene glycols, terpenes, n-alkanes, isoalkanes, nitrogenous solvents such as N-methylpyrrolidone, solubilizers, antiredeposition agents, dispersants, processing aids, softeners and antistats and also bleaching agents.

EXAMPLES

Example 1

Dissolving Power of Tetramethoxyethane for Oily and Greasy Soil

The removal of a paraffin oil stain from cotton-polyester fabric with tetramethoxyethane compared with other solvents was investigated. The wfk 20A standard test fabric from the Wäschereiforschungsanstalt Krefeld laundry research institute was soiled with paraffin oil colored with the solvent dye Sudan Red. To simulate a stain spray or remover, the test fabric was then placed in tetramethoxyethane or the reference solvent for 10 min. The test fabric was subsequently removed and washed in a solvent-moist state with an aqueous wash liquor comprising the IEC-A standard laundry detergent (phosphate-free laundry detergent from Wäschereiforschungsanstalt Krefeld laundry research institute) at 40° C. for 30 min. The test fabric was rinsed with clear water, dried and then measured for whiteness as a measure for stain removal. The higher the whiteness, the better the removal of the red oily stain.

TABLE 1

Removal of paraffin oil from wfk 20A cotton-polyester fabric by tetramethoxyethane compared with reference solvents. Quantification via whiteness.

| | Whiteness (%) |
|---|---|
| Oil stain pretreated with test solvent: | |
| Tetramethoxyethane | 82.5 |
| and pretreated with reference solvents: | |
| Centralin | 81.0 |
| Isopropanol | 79.7 |
| Butyldiglycol | 81.1 |
| Dipropylene glycol | 74.3 |
| Tripropylene glycol | 74.4 |
| Ethylene glycol phenyl ether | 80.2 |
| Propylene glycol phenyl ether | 80.1 |

As well as the attained whiteness (reflectance), the color difference dE of the soiled and then washed fabric compared to the unsoiled fabric was likewise determined. The smaller the color difference dE, the lesser the residue of the colored paraffin oil on the fabric. Ideally, dE is equal to zero.

TABLE 2

Removal of paraffin oil from wfk 20A cotton-polyester fabric by tetramethoxyethane compared with reference solvents. Quantification via color difference dE.

| | Color difference dE to unsoiled test fabric |
|---|---|
| Oil stain pretreated with test solvent: | |
| Tetramethoxyethane | 4.1 |
| and pretreated with reference solvents: | |
| Centralin | 4.7 |
| Isopropanol | 7.6 |
| Butyldiglycol | 5.2 |
| Dipropylene glycol | 13.7 |
| Tripropylene glycol | 13.3 |
| Ethylene glycol phenyl ether | 7.0 |
| Propylene glycol phenyl ether | 6.8 |

Example 2

Liquid Laundry Detergent Comprising Tetramethoxyethane

TABLE 3

Liquid laundry detergent

| Liquid laundry detergent | Composition: |
|---|---|
| Hostapur SAS 60 | 13% |
| Potassium coco soap (27%) | 10% |
| Genapol LA-070 | 23% |
| Tetramethoxyethane | 5% |
| Citric acid | 1% |

TABLE 3-continued

Liquid laundry detergent

| Liquid laundry detergent | Composition: |
|---|---|
| Dequest 2010 | 0.3% |
| Enzymes | q.s. |
| Colorant | q.s. |
| Perfume | q.s. |
| Water | ad 100% |

Example 3

Stain Sprays, Prewash Sprays and Detergent Boosters for Textiles

TABLE 4

Stain sprays

| | Composition (%) | |
|---|---|---|
| Formulation: | A | B |
| Tetramethoxyethane | 25 | 35 |
| Hydrocarbons | 45 | 35 |
| Genapol OX-030 | 15 | 15 |
| Prapagen HY | 5 | 5 |
| Ethanol | 10 | 10 |

TABLE 5

Prewash sprays

| | Composition (%) | |
|---|---|---|
| Formulation: | A | B |
| Tetramethoxyethane | 10 | 20 |
| Butyldiglycol | 10 | 10 |
| Isopropanol | 10 | 5 |
| Genapol UD-050 | 5 | 5 |
| Hostapur SAS 30 | 3.5 | — |
| Water | ad 100 | ad 100 |

TABLE 6

Detergent boosters

| | Composition (%) |
|---|---|
| Tetramethoxyethane | 5 |
| Potassium coco soap (27%) | 10 |
| Genapol LA-070 | 23 |
| Hostapur SAS 60 | 13 |
| Citric acid | 1 |
| Water | ad 100 |

Example 4

Dishwasher Rinse Aids

TABLE 7

Dishwasher rinse aids

| Formulation: | Composition (%) A | Composition (%) B |
|---|---|---|
| Genapol EP 2564 | 14.0 | 5.0 |
| Genapol EP 2552 | — | 10.0 |
| Tetramethoxyethane | 4.0 | 6.0 |
| Citric acid × $H_2O$ | 3.0 | 3.0 |
| Water | ad 100 | ad 100 |

Example 5

Glass Cleaner

TABLE 8

Glass cleaner

| Formulation: | Composition (%) A | Composition (%) B |
|---|---|---|
| Tetramethoxyethane | 29 | 14.5 |
| Ammoniacal water | 0.5 | 0.5 |
| Ethanol | — | 14.5 |
| Genapol LRO liq. | 0.5 | 0.5 |
| Water | ad 100 | ad 100 |

Example 6

All-Purpose Cleaner

TABLE 9

All-purpose cleaner

| Formulation: | Composition (%) A | Composition (%) B |
|---|---|---|
| Hostapur SAS 60 | 1.7 | 1.7 |
| Genapol UD-080 | 4 | 4 |
| Sokalan CP 5 | 2 | — |
| Sodium citrate | — | 2 |
| Tetramethoxyethane | 2 | 2 |
| Water | ad 100 | ad 100 |

Commercial Products Used:

Centralin®=commercially available stain remover, mixture of hydrocarbons and alcohols.

Sokalan® CP 5=maleic acid-acrylic acid copolymer, sodium salt, 40%, molar mass 70 000 (from BASF)

Dequest® 2010=1-hydroxyethane-1,1-diphosphonic acid, about 60% (from Solutia)

Clariant Products Used:

Genapol® OX-030=$C_{12-15}$ oxo alcohol polyglycol ether with 3 mol of ethylene oxide, 100%.

Genapol® UD-050=$C_{11}$ oxo alcohol polyglycol ether with 5 mol of ethylene oxide, 100%.

Genapol® UD-080=$C_{11}$ oxo alcohol polyglycol ether with 8 mol of ethylene oxide, 100%.

Genapol® LA-070=$C_{12/14}$-alkyl polyglycol ether with 7 mol of ethylene oxide, 100%.

Genapol® EP 2564=ethylene oxide-propylene oxide adduct with $C_{12-15}$ oxo alcohol, 100%.

Genapol® EP 2552=ethylene oxide-propylene oxide adduct with $C_{12-15}$ oxo alcohol, 100%.

Präpagen® HY=$C_{12/14}$-alkylhydroxyethyldimethylammonium chloride, 40%.

Hostapur® SAS 30=secondary $C_{14-17}$-alkanesulfonate, sodium salt, 30%.

Hostapur® SAS 60=secondary $C_{14-17}$-alkanesulfonate, sodium salt, 60%.

Genapol® LRO liq.=$C_{12/14}$-alkyl diglycol ether sulfate, sodium salt, 27%.

I claim:

1. A method for cleaning and dissolving stains on a solid surface, said method comprising contacting said surface with a composition consisting of:

1 to 80 % by weight of tetramethoxyethane or tetraethoxyethane and optionally at at least one component selected from the group consisting of a surfactant, an alcohol, a glycol ether, a hydrocarbon solvent, a soap, a builder, an enzyme, an optical brightener, a bleaching agent, a soil release polymer, a dye transfer inhibitor, a complexing agent, a colorant, a siloxane, a perfume, phosphonic acid or a salt thereof, a citric acid or a salt thereof, urea, a hydrotrope, a polycarboxylate, and water.

2. The method of claim 1, wherein the hard surface is selected from the group consisting of a textile fiber, a metallic surface, a ceramic surface, glass, porcelain, and plastic.

3. The method of claim 1, wherein the composition is a stain spray and said hard surface is a textile fiber, said contacting step being a spraying step, and wherein said composition consists of 11 to 40 % by weight of tetrarnethoxyethane or tetraethoxyethane, and the at least one component is selected from the group consisting of a surfactant, an alcohol, a glycol ether, a soap, water, and a bleaching agent.

4. The method of claim 1, wherein the composition is an all purpose cleaner and wherein said composition consists of 1 to 5 % by weight of tetramethoxyethane or tetraethoxyethane, and the at least one component is a selected from the group consisting of surfactant, a soap, a perfume, a colorant, phosphonic acid or a salt thereof, a citric acid or a salt thereof, urea, a hydrotrope, a polycarboxylate, and water.

5. The method of claim 1, wherein the composition is a stain remover and wherein said composition consists of 1 to 60 % by weight of tetramethoxyethane or tetraethoxyethane, and the at least one component is selected from the group consisting of an alcohol or a hydrocarbon solvent.

* * * * *